US010731664B2

(12) United States Patent
Iurisci et al.

(10) Patent No.: US 10,731,664 B2
(45) Date of Patent: Aug. 4, 2020

(54) CENTRIFUGAL COMPRESSORS WITH INTEGRATED INTERCOOLING

(71) Applicant: Nuovo Pignone Srl, Florence (IT)

(72) Inventors: Giuseppe Iurisci, Florence (IT); Christian Aalburg, Garching b. Muenchen (DE); Giuseppe Sassanelli, Florence (IT); Luciano Mei, Florence (IT); Simon Schoewel, Garching b. Muenchen (DE); Pawel Twarowski, Warsaw (PL); Marek Watrobski, Warsaw (PL)

(73) Assignee: NUOVO PIGNONE TECHNOLOGIE SRL, Florence (IT)

( * ) Notice: Subject to any disclaimer, the term of this patent is extended or adjusted under 35 U.S.C. 154(b) by 415 days.

(21) Appl. No.: 15/507,623

(22) PCT Filed: Aug. 27, 2015

(86) PCT No.: PCT/EP2015/069621

§ 371 (c)(1),
(2) Date: Feb. 28, 2017

(87) PCT Pub. No.: WO2016/030453

PCT Pub. Date: Mar. 3, 2016

(65) Prior Publication Data

US 2017/0306979 A1 Oct. 26, 2017

(30) Foreign Application Priority Data

Aug. 28, 2014 (EP) ..... 14461565

(51) Int. Cl.
*F04D 29/58* (2006.01)
*F04D 29/44* (2006.01)
*F01D 25/08* (2006.01)

(52) U.S. Cl.
CPC ..... *F04D 29/584* (2013.01); *F04D 29/44* (2013.01); *F04D 29/441* (2013.01);
(Continued)

(58) Field of Classification Search
CPC ..... F04D 29/584; F04D 29/44; F04D 29/441; F04D 29/5826; F04D 29/444; F01D 25/08
See application file for complete search history.

(56) References Cited

U.S. PATENT DOCUMENTS 6,203,275 B1 * 3/2001 Kobayashi ..... F04D 17/122 415/199.2
8,814,509 B2 * 8/2014 Moore ..... F04D 17/122 415/179

(Continued)

FOREIGN PATENT DOCUMENTS

JP H06-294398 A 10/1994
NL 59 665 C 6/1947

(Continued)

OTHER PUBLICATIONS

Moore, J.J., et al., "Development of an internally cooled centrifugal compressor for carbon capture and storage applications," Proceedings of ASME Turbo Expo 2012, pp. 1-10 (Jun. 11-15, 2012).
Extended European Search Report and Opinion issued in connection with corresponding EP Application No. 14461565.5 dated Feb. 9, 2015.
International Search Report and Written Opinion issued in connection with corresponding PCT Application No. PCT/EP2015/069621 dated Nov. 4, 2015.

(Continued)

*Primary Examiner* — David Hamaoui
(74) *Attorney, Agent, or Firm* — Baker Hughes Patent Organization

(57) ABSTRACT

A compressor comprising: a casing; an upstream impeller and a downstream impeller for rotation in the casing; a diaphragm comprised of an internal portion and an external portion; an upstream diffuser fluidly coupled to an outlet of the upstream impeller; a return channel fluidly coupled to the upstream diffuser and to an inlet of the downstream (Continued)

impeller, the return channel has a plurality of return-channel blades connecting the internal and external diaphragm portions; and a downstream diffuser fluidly coupled to an outlet of the downstream impeller is disclosed. A first coolant passage is in the internal diaphragm portion and extends around an inner core, the first coolant passage being in heat-exchange relationship with the upstream diffuser and the return channel. A second coolant passage and third coolant passage are separated by a second inner core in the external diaphragm portion and in a heat-exchange relationship with the return channel and the downstream diffuser.

13 Claims, 7 Drawing Sheets

(52) U.S. Cl.
CPC ..... *F04D 29/444* (2013.01); *F04D 29/5826* (2013.01); *F01D 25/08* (2013.01)

(56) References Cited

U.S. PATENT DOCUMENTS

| | | | | |
|---|---|---|---|---|
| 2009/0047127 | A1 | 2/2009 | Commaret et al. | |
| 2012/0063882 | A1 | 3/2012 | Moore et al. | |
| 2018/0291927 | A1* | 10/2018 | Kerth | F04D 29/5833 |

FOREIGN PATENT DOCUMENTS

| | | | |
|---|---|---|---|
| RU | 2364755 | C1 | 8/2009 |
| RU | 2485356 | C2 | 6/2013 |

OTHER PUBLICATIONS

International Preliminary Report on Patentability issued in connection with corresponding PCT Application No. PCT/EP20151069621 dated Feb. 28, 2017.

RU Acceptance and Search Report issued in connection with corresponding Application No. 2017105343 dated Feb. 1, 2019.

* cited by examiner

STATE OF THE ART

STATE OF THE ART

Fig.7
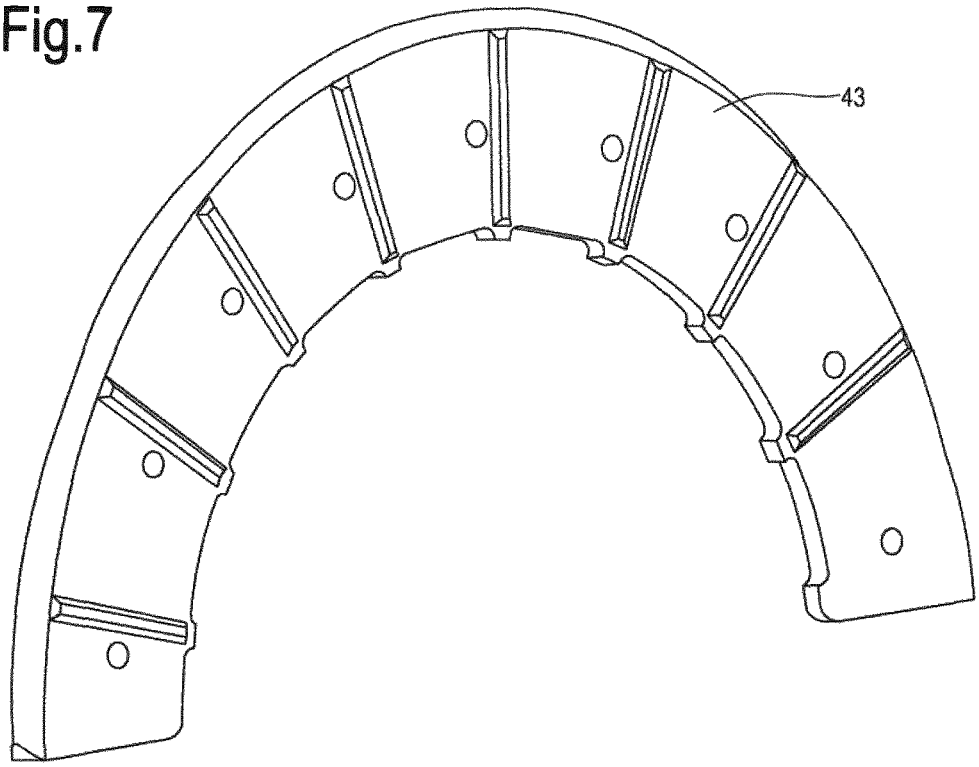
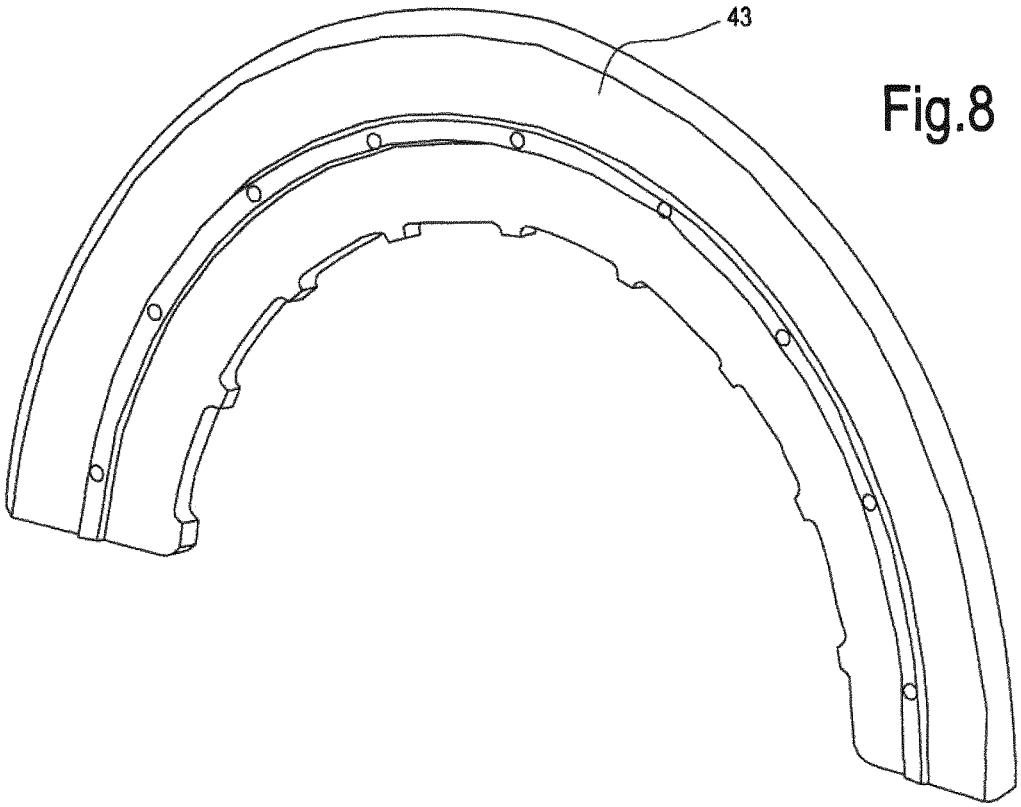
Fig.8

CENTRIFUGAL COMPRESSORS WITH INTEGRATED INTERCOOLING

BACKGROUND

Embodiments of the invention relate generally to centrifugal compressors. More specifically, embodiments of the invention relate to internally-cooled centrifugal compressors for improving compressor efficiency.

Compressors are well known in several industrial applications as machines having a primary function of increasing the pressure of a gas. Gas processed by a compressor is subject not only to pressure increase but also to temperature increase, due to heat developing in the gas when mechanical work is applied thereto for compressing the gas. Therefore, the gas temperature is considerably higher at the delivery side than at the suction side of the compressor. This is particularly the case when the compressor is a multistage compressor, including a plurality of sequentially arranged impellers, each provided with respective diffuser and return-channel. A multi-stage compressor achieves a high pressure ratio, which is linked with high temperature increase.

Due to the temperature increase, gas compression requires a large amount of power. In order to reduce the power required to achieve a certain pressure ratio, it is known to arrange so-called interstage coolers or intercoolers between one compression stage and the next. Intercooling reduces the density of the gas and the temperature thereof, removing heat from the gas delivered by one compressor stage before delivering the gas to the subsequent compressor stage.

The use of one or more interstage intercoolers improves the overall efficiency of the compressor. However, intercoolers are complex and cumbersome devices, which increase the footprint and overall dimension of the compressor and the cost thereof.

Moreover, the use of intercoolers requires complex piping to be arranged in order to have the gas flowing out of a compressor stage, through the intercooler and be again delivered at the inlet of the subsequent compressor stage.

In recent times, efforts have been made to design so-called internally cooled centrifugal compressors, which are simpler and more efficient. FIGS. 1A and 1B illustrate a known internally cooled centrifugal compressor of the current art.

More specifically, FIG. 1A illustrates a sectional schematic view of two sequentially arranged compressor stages 101, 102 of an internally cooled centrifugal compressor 100 of the current art and FIG. 1B illustrates an enlargement of the return-channel and diffuser of one of the compressor stages 101, 102. As shown in FIGS. 1A and 1B, compressor 100 comprises a shaft 105 arranged for rotation in a casing 107. Impellers 108, 109 are mounted for rotation on the shaft 105. A diffuser 110 is arranged at the outlet of impeller 108 and is fluidly coupled to a respective return-channel 111. The return-channel 111 is provided with return-channel blades or vanes 112 which connect an internal diaphragm portion 113 to an external diaphragm portion 114. The return-channel 111 is fluidly coupled to the inlet of the second impeller 109. A diffuser 115 is fluidly coupled to the outlet of the second impeller 109 and with a second return-channel 117 which can also be provided with return-channel blades 119 connecting the respective internal diaphragm portion 120 with the external diaphragm portion 114.

Gas entering the first impeller 180 is accelerated by the rotation of the impeller and subsequently slowed down in the diffuser 110, such that at least part of the kinetic energy imparted to the gas by the rotating impeller is converted into pressure energy. The partly pressurized gas is returned through return-channel 111 to the second impeller 109 for further acceleration. In diffuser 115 the accelerated gas delivered by the second impeller 109 is again slowed down and kinetic energy is partly converted into pressure energy and the gas is returned trough the return-channel 119 towards a further downstream compressor stage, not shown.

In order to improve the compressor efficiency a cooling channeling 123 is combined with the first compressor stage 101 and a second cooling channeling 124 is combined with the second compressor stage 102. As shown in the enlargement of FIG. 1B, according to the current art the channeling 123 and similarly the channeling 124 comprise a plurality of pipes extending from the external diaphragm portion through the return-channel blades 112, in the internal diaphragm portion 113 and back towards the external diaphragm portion. A coolant, for example, a liquid or a gas or a two phase fluid thus circulates through the internal diaphragm portion 113 and the blading 112, 119, to remove heat.

The efficiency of known heat removal systems integrated in the centrifugal compressors of the current art are not particularly efficient. According to known embodiments, the surface of heat exchange between the processed gas and the coolant Thus a need exists for more efficient cooling arrangements, in order to improve the efficiency of internally cooled centrifugal compressors.

BRIEF DESCRIPTION OF THE INVENTION

According to some embodiments, an internally cooled centrifugal compressor is provided, including a casing, at least an upstream impeller and a downstream impeller sequentially arranged for rotation in the casing and a stationary diaphragm arranged in the casing and comprised of an internal diaphragm portion and an external diaphragm portion. The compressor can further comprise an upstream diffuser fluidly coupled to an outlet of the upstream impeller. A return channel can be fluidly coupled to the upstream diffuser and to an inlet of the downstream impeller. The return channel can be provided with a plurality of return-channel blades connecting the internal diaphragm portion to the external diaphragm portion. A downstream diffuser is furthermore fluidly coupled to an outlet of the downstream impeller.

According to embodiments disclosed herein, a first coolant passage is provided in the internal diffuser portion and extends around a first inner core arranged in the internal diaphragm portion. The first coolant passage is advantageously in heat-exchange relationship with the upstream diffuser and the return channel. Between the outer surface of the inner diaphragm portion and the first inner core arranged therein a thin fluid passage or meatus is thus generated, wherein a coolant is forcedly circulated. The small sectional dimension of the meatus causes the coolant to move at high velocity in thermal-exchange contact with the inner surface of the peripheral wall formed by the inner diaphragm portion which surrounds the first inner core. The high coolant velocity improves heat removal by convection from the gas which contacts the outer surface of said peripheral wall.

According to some embodiments a second coolant passage and a third coolant passage are provided in the external diaphragm portion, separated by a second inner core arranged in the external diaphragm portion. The second and third coolant passages are in heat-exchange relationship with the return channel and the downstream diffuser, so that coolant circulating through the second and third coolant passages removes heat by convection from the gas through walls of the external diaphragm portion which surround the second inner core. The second and third coolant passages can each be in the form of a thin meatus, wherein the coolant circulates with a high velocity, thus improving the heat removal by forced convection.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIGS. 7 and 8 illustrate fragmentary perspective views of the inner core of one of the internal diaphragm portions of the compressor of FIG. 3.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1A:
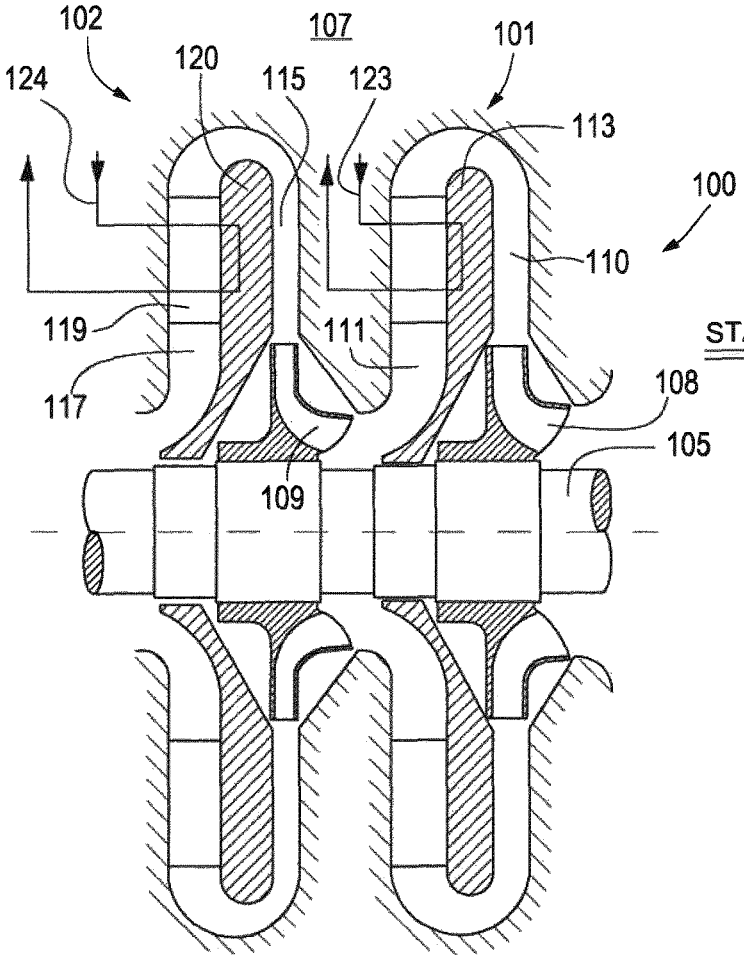
FIGS. 1A and 1B illustrate a portion of a multi-stage centrifugal compressor with integrated intercooling according to the current art.
Figure 1B:
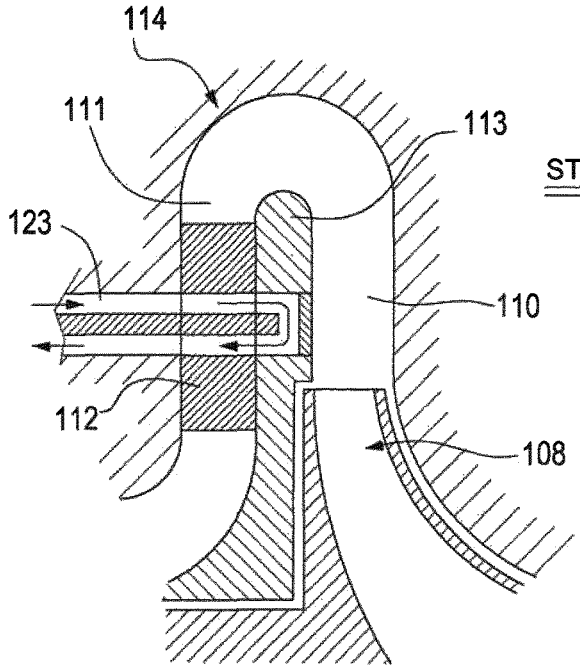
Figure 2:
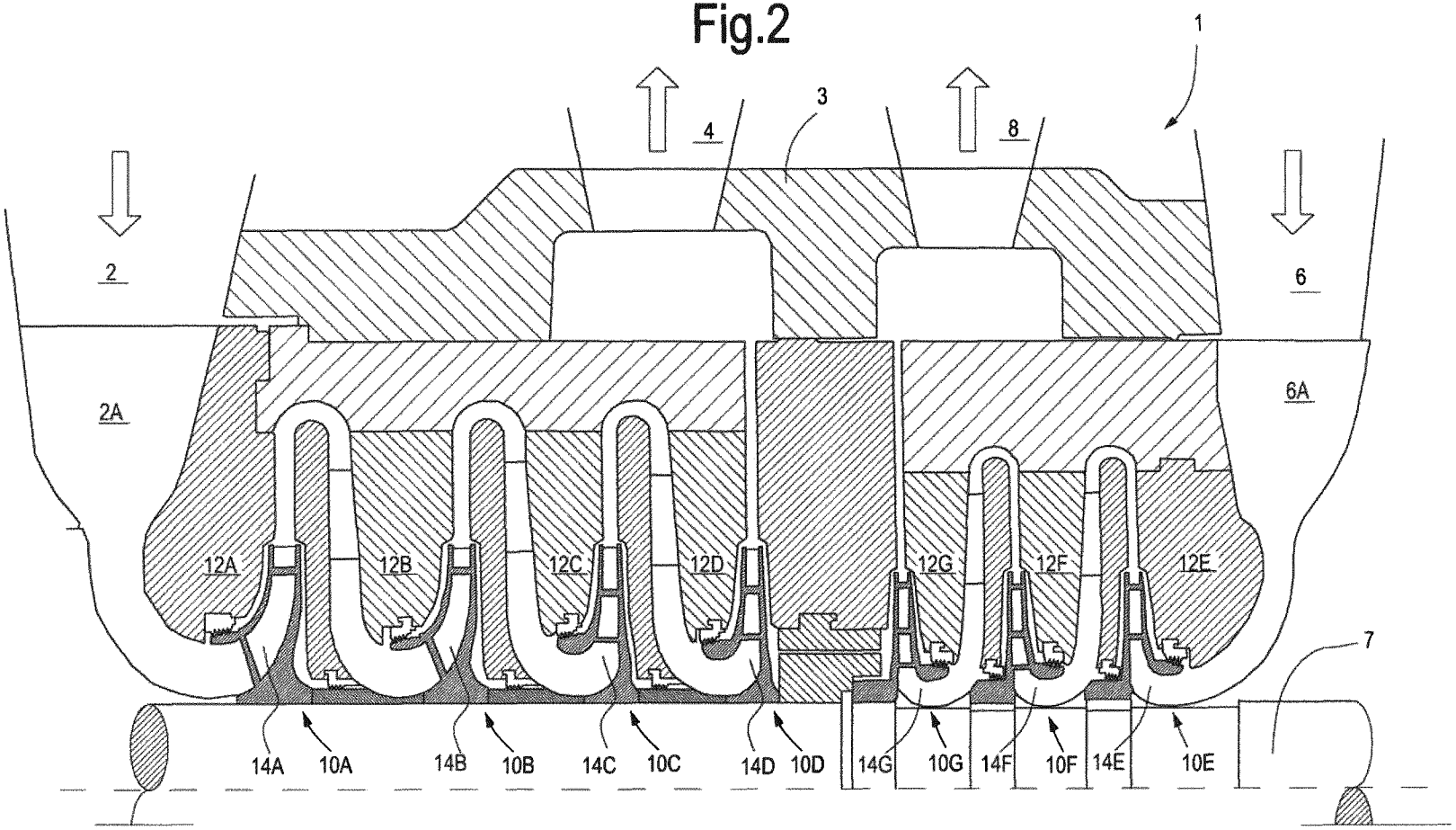
FIG. 2 illustrates a schematic sectional view of an exemplary multi-stage centrifugal compressor, wherein the subject matter disclosed herein can be embodied.

FIG. 2 illustrates a sectional view of a multi-stage centrifugal compressor, wherein the subject matter disclosed herein can be embodied. The compressor is labeled 1 as a whole. In the exemplary embodiment of FIG. 2 the compressor 1 comprises groups of compressor stages which are mounted in a back-to-back configuration. The compressor 1 can comprise a casing 5 with a first gas inlet 2 and a first gas outlet 4.

A first group of compressor stages 10A, 10B, 10C 10D can be arranged sequentially between gas inlet 2 and gas outlet 4. The compressor 1 can comprise a second gas inlet 6, which is fluidly coupled to the first gas outlet 4, and a second gas outlet 8.

A second group of compressor stages 10E, 10F, 10G can be sequentially arranged between the second gas inlet and the second gas outlet 8.

Each compressor stage 10A-10G can be comprised of a respective impeller 14A-14G. The impellers can be mounted on a rotary shaft 7 for rotation in casing 3. Moreover, the compressor is comprised of stationary diaphragms. In FIG. 2 the diaphragms are schematically shown at 12A-12G, respectively. The most upstream diaphragm 12A is arranged between a gas inlet plenum 2A and the first impeller 14A. The diaphragm 12E is arranged between a second gas inlet plenum 6A and the first impeller 14E of the second group of compressor stages. The remaining diaphragms are each positioned between two sequentially arranged impellers or respective compressor stages.

As will be described in greater detail later on, each diaphragm arranged between two subsequent impellers can be comprised of an internal diaphragm portion and an external diaphragm portion.

In some embodiments, at least some of the stationary diaphragms can be provided with a refrigeration or intercooling system, for removing heat from the gas processed therethrough. For instance, diaphragms 12B-12D and 12F-12G can be refrigerated.

Figure 3:
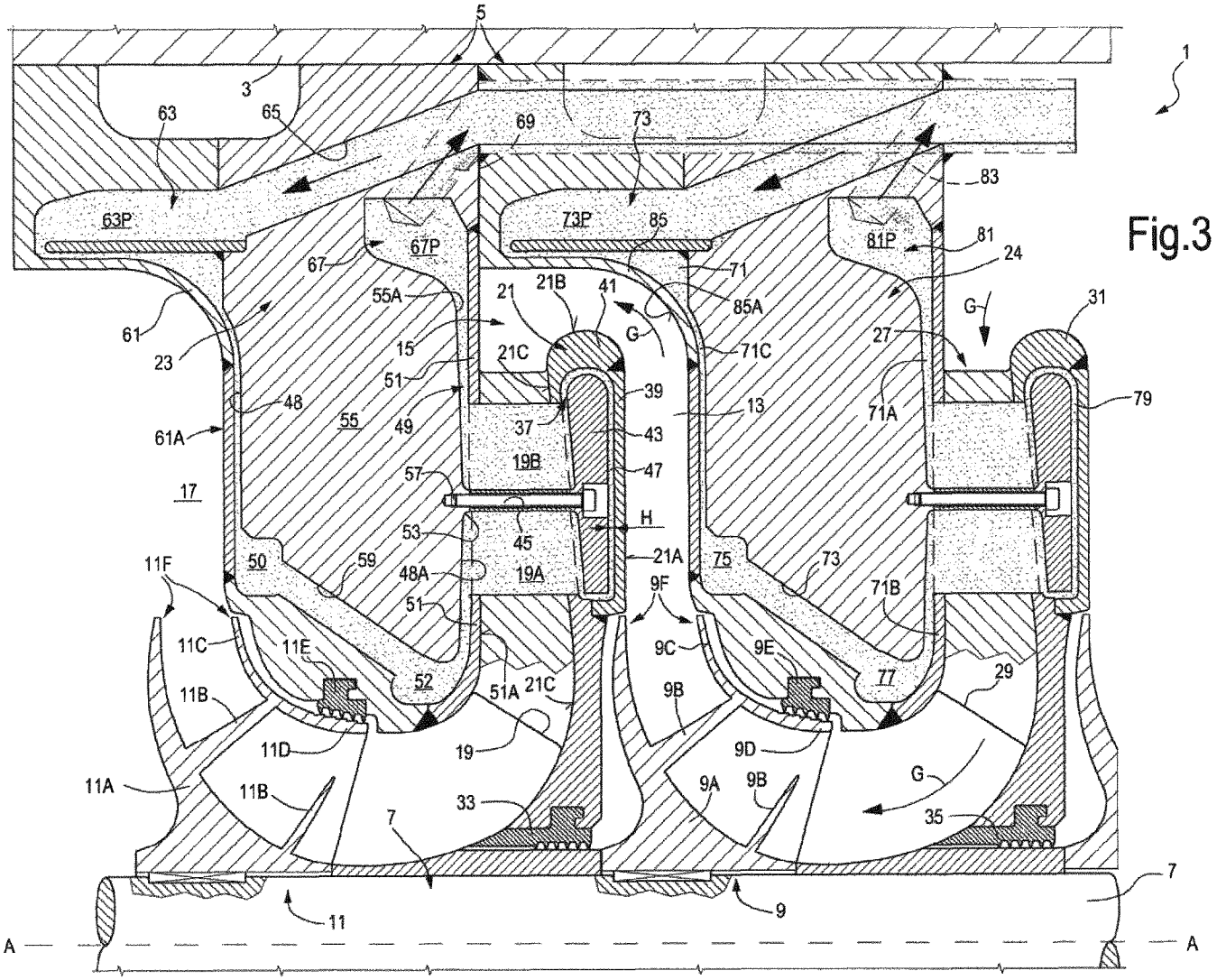
FIGS. 3 and 4 illustrate fragmentary sectional views of two embodiments of centrifugal compressors with integrated intercooling according to embodiments of the subject matter disclosed herein.

FIG. 3 illustrates a partial sectional view of two stages of a multistage centrifugal compressor 1 with integrated intercooling according to some embodiments of the present disclosure. FIG. 3 shows only two stages of the multistage compressor. It shall be understood that, in a manner known per se, the compressor may comprise more than just two compressor stages. Usually the compressor further includes an inlet plenum and an outlet plenum or an outlet scroll, not shown. The inlet and the outlet of the compressor are fluidly coupled with to a suction manifold and a delivery manifold, not shown. The compressor stages can be arranged in any known manner. For instance, the compressor can include a so-called back-to-back impeller arrangement, wherein the impellers of the compressor stages are divided into two groups. The overall direction of flow through the impellers of the first group is opposite the overall direction of flow through the impellers of the second group, so that axial thrust on the compressor shaft generated by the action of the impellers on the gas flow is at least partly balanced. FIGS. 5 to 8 illustrate perspective fragmentary views of components of the second compressor stage of compressor 1 in FIG. 3.

FIG. 3 illustrates two impellers belonging to two adjacent compressor stages, with an intercooling system therebetween. It shall be understood that the compressor can include more than just one pair of sequentially arranged upstream and downstream impellers with or without an intercooling associated thereof, as schematically shown in FIG. 2. For instance, some of the compressor stages can be provided with integrated intercooling, some may not. Integrated intercooling can be provided for instance in the most downstream compressor stages where higher pressure values are achieved and where thus higher gas temperatures would be achieved if no intercooling were provided. One or more compressor stages in the most upstream area thereof can be devoid of intercooling.

In some embodiments compressor 1 comprises an outer casing schematically shown at 3, which houses diaphragms 5. Compressor 1 can further comprise a shaft 7 arranged for rotation in the casing 3. A plurality of impellers can be mounted on shaft 7 for rotation therewith. In the sectional view of FIG. 3 only an upstream impeller 9 and a downstream impeller 11 are shown, but the compressor 1 can comprise three or more impellers, depending for instance upon the pressure ration for which the compressor has been designed.

Impellers 9 and 11 can be substantially similar to one another, as shown in FIG. 3. Their dimension can be slightly different in consideration of the reduced volume rate of the gas processed by the two impellers 9, 11 which are arranged in sequence along the compressor 1. In usual situations, where no side streams are provided between the two sequentially arranged impellers 9, 11, the downstream impeller 11 processes the same mass flow as the upstream impeller 9, but a smaller volume rate, due to the compression of the gas operated by the upstream impeller 9.

The impellers 9 and 11 can correspond to any one of impellers 14A-14G of the schematic of FIG. 2

Two sequentially arranged upstream and downstream impeller 9, 11 are combined with a respective stationary diaphragm 5. As will be described later on, each stationary diaphragm 5 can comprise two portions which are usually named internal diaphragm portion and external diaphragm portion. The internal diaphragm portion is arranged upstream of the external diaphragm portion, referring to the direction of the gas processed by the compressor.

Each impeller 9, 11 is comprised of a respective impeller disc 9A, 11A and a plurality of impeller blades 9B, 11B. In some embodiments the impellers can be provided with respective shrouds 9C, 11C. In other embodiments, not shown, the impellers 9, 11 can be open, i.e. unshrouded. The shrouds 9C, 11C can each be provided with an impeller eye 9D which co-acts with a respective impeller sealing arrangement 9E 11E.

Downstream of the upstream impeller 9 an upstream diffuser 13 is arranged, fluidly coupled to the outlet of the upstream impeller 9. Gas accelerated by the impeller 9 is slowed down in the diffuser 13, such that at least part of the kinetic energy delivered to the gas by the impeller 9 is converted into pressure energy. A return channel 15 is fluidly coupled to the outlet of the upstream diffuser 13 and to the inlet of downstream impeller 11. The gas flow G is returned through a return channel 15 towards the inlet of the downstream impeller 11. A downstream diffuser 17, similar to upstream diffuser 13 and only partly shown in FIG. 3, can be arranged in fluid communication with the outlet of the downstream impeller 11, with an arrangement quite similar to upstream diffuser 13.

If a further impeller is arranged downstream of impeller 11, a further return-channel (not shown) will deliver the gas flowing from the outlet of downstream diffuser 17 towards the inlet of the next impeller. In other embodiments, the downstream diffuser 17 can be fluidly coupled to a scroll or volute, for collecting the compressed gas and delivering the compressed gas towards a compressor delivery manifold.

In some embodiments, not shown, the diffuser 13 can be bladed, i.e. provided with stationary blades or so called vanes. In other embodiments, as shown in FIG. 3, the diffuser 13 can be devoid of stationary blades and may have the shape of an annular open space extending radially from the outlet 9F of the upstream impeller 9 towards the inlet of return-channel 15.

The return-channel 15 can be provided with a plurality of stationary blades or vanes 19. Here below the vanes or blades 19 will be designated as return-channel blades 19. The return-channel blades 19 can be uniformly distributed around the rotation axis A-A of the impellers 9, 11.

Between the diffuser 13 and the return-channel 15 an internal diaphragm portion 21 is arranged. The internal diaphragm portion 21 can have a substantially annular shape and may be connected mechanically by means of the return-channel blades 19 to an external diaphragm portion 23. The external diaphragm portion 23 and the internal diaphragm portion 21 form the return-channel 15. In some embodiments the internal diaphragm portion 21 can have outer surfaces 21A, 21B, 21C. The outer surface 21A faces the upstream diffuser 13 and is in fluid contact with the gas flowing through the upstream diffuser. The outer surface 21B is the most radially outward outer surface of the internal diaphragm portion 21 and is arranged at the apex of the upstream diffuser 13, where the latter connects with the return channel 15. Thus, the surface 21B is in fluid contact with the gas moving from the diffuser 13 towards the return channel 15. The third outer surface 21C extends along the return channel 15 and is in fluid contact with the gas flowing through the return channel 15 and between the return-channel blades 19.

The upstream diffuser 13 is formed by the internal diaphragm portion 21 and by the external diaphragm portion 23 of a diaphragm arranged upstream of impeller 9. Similarly, the downstream diffuser 17 is formed by the external diaphragm portion 23 of the diaphragm 5 arranged between upstream and downstream impellers 9, 11 and by the internal diaphragm portion (not shown) of the next impeller or by the compressor volute or scroll (not shown).

The internal diaphragm portion 21 and the external diaphragm portion 23 form therein a cooling arrangement, where through a coolant agent flows, as will be described in greater detail here below.

In some embodiments, the centrifugal compressor 1 can comprise a further upstream compressor stage, whereof reference number 27 indicates the respective return-channel having return-channel blades 29 therein. The return-channel 27 of the upstream compressor stage is formed between the external diaphragm portion 23 and a respective further internal diaphragm portion 31, which is mechanically connected to the external diaphragm portion 23 through the return-channel blades 29. As will become apparent from the following description, in the exemplary embodiment of FIG.

3 integrated intercooling is provided also between impeller 9 and the impeller upstream thereof. In other embodiments, intercooling upstream of the impeller 9 can be dispensed with. In some exemplary embodiments, the impeller 9 can be the first compressor impeller, in which case an inlet plenum will be provided upstream thereof, rather than return channel 27.

According to some embodiments, the internal diaphragm portion 21 can be provided with a sealing arrangement 33 co-acting with shaft 7. A similar sealing arrangement 35 can be provided between the further upstream internal diaphragm portion 31 and shaft 7.

In embodiments disclosed herein, the internal diaphragm portion 21 has an inner cavity 37 which can be closed by means of a cover or plate 39. The cover or plate 39 can be welded to a main body 41 of the internal diaphragm portion 21. In other embodiments, connection between the main body 41 and the cover can be by screwing or in any outer suitable manner. As can be appreciated from FIG. 3, the cover 39 can have an annular shape and extend around the rotation axis A-A of compressor 1.

The inner cavity 37 has an annular development around the rotation axis A-A. In some embodiments, a first inner core 43 is arranged inside the inner cavity 37. The inner core 43 can have an annular shape. In some embodiments the inner core 43 is connected through a plurality of screws or other suitable means 45 to the external diaphragm portion 23. In some embodiments the screws 45 extend through respective return-channel blades 19. The return-channel blades 19 in combination with screws 45 thus connect the internal diaphragm portion 21 to the external diaphragm portion 23.

In some embodiments the inner core 43 and the inner surface of the inner cavity 37 form a first coolant passage 47. As can be appreciated from FIG. 3, in some embodiments the first coolant passage 47 has a substantially loop-shaped section in a radial plane, i.e. in a plane containing the rotation axis A-A.

The first coolant passage 47 can extend around and behind the outer surfaces 21A, 21B, 21C of the internal diaphragm portion 21. The coolant passage 47 can be provided with a first section in heat-exchange relationship with the return-channel 15 and a second section in heat-exchange relationship with the diffuser 13.

More specifically, the coolant passage 47 has a portion thereof arranged behind the outer surface 21C of the internal diaphragm portion 21 in heat-exchange relationship with the return-channel 15 and a portion behind surface 21A in heat-exchange relationship with the return-channel 13.

In some embodiments the coolant passage 47 has a transversal dimension or height H which is relatively narrow with respect to the other dimensions of the coolant passage 47, such that the coolant agent flowing there through has a high speed, which increases the thermal efficiency of the cooling system, as the high speed of the coolant agent improves heat removal by convection. To further improve heat exchange between the coolant agent circulating through the coolant passage 47 and the outer surface and wall of the internal diaphragm portion 21, ribs having a generally radial orientation can be provided in the coolant passage 47. These latter can further increase speed and turbulence of the coolant agent, thus further improving heat removal by convection through the inner surface of the coolant passage 47 facing the outer surfaces 21A, 21B, 21C.

In the external diaphragm portion 23 on the side of the return-channel 15, a coolant channeling is formed, through which coolant is caused to flow around the diaphragm portion 23 and through the coolant passage 47.

In some embodiments, the external diaphragm portion 23 comprises a second inner core 55 and coolant passages extending at least partly around the second inner core 55 as described in more detail here below.

According to some embodiments, a second coolant passage 49 is provided, which extends behind a substantially annular wall 51 of the external diaphragm portion 23. More specifically, the second coolant passage 49 can extend between the annular wall 51 and the second inner core 55. The outer surface 51A of the annular wall 51 can form the downstream inner surface of the return-channel 15, facing surface 21C formed by the internal diaphragm portion 21.

A third coolant passage 48 can be provided around the second inner core 55. The third coolant passage 48 extends mainly around the second inner core 55 on the side opposite the second coolant passage 49, i.e. along the side of the second inner core 55 facing the downstream return channel 17. The third coolant passage 48 partly extends around the second inner core 55 in 48A, behind the annular wall 51. The second coolant passage 49 and the third coolant passage 48, 48A can be separated from one another by an annular ridge 53. The ridge 53 prevents the coolant agent from flowing from the portion 48A of the third coolant passage directly into the second coolant passage 49.

At least some of the return-channel blades 19 are provided with respective inlet ducts 19A and outlet ducts 19B. In some embodiments, the inlet duct 19A of each return-channel blade 19 is radially inwardly arranged while the outlet duct 19B is arranged radially outwardly. The ducts 19A form inlet ducts in fluid communication with the third coolant passage 48A and with the first coolant passage 47 formed in the internal diaphragm portion 21. The ducts 19B form outlet ducts in fluid communication with the first coolant passage 47 in the internal diaphragm portion 21 and with the second coolant passage 49. The arrangement is such that coolant agent flows through the third coolant duct 48, 48A, inlet ducts 19A, first coolant passage 47, outlet ducts 19B and second coolant passage 49.

In some embodiments, the third coolant passage 48 extends behind a third wall 61, the outer surface 61A whereof forms one of the inner surfaces of the downstream diffuser 17 arranged at the outlet 11F of the second impeller 11. Coolant agent flowing there along thus removes heat through third wall 61 from gas flowing through the downstream diffuser 17.

Coolant agent flowing through the portion 48A of the third coolant passage removes heat from the most downstream portion of the return channel 15.

Coolant agent flowing through the second coolant passage 49 removes heat from the first portion (i.e. the most upstream portion, according to the direction of flow of the gas) of the return channel 15.

In some embodiments, the third coolant passage 48 is in fluid communication with a coolant inlet 63 which can comprise a coolant-inlet plenum 63P. According to some embodiments, the coolant-inlet plenum 63P has an annular shape and extends around the rotation axis A-A. One or more coolant delivery ducts 65 can be in fluid communication with the coolant inlet 63 for delivering a coolant agent therein. In some embodiments, the coolant-inlet plenum 63P can be semi-annular and two said coolant-inlet plenums 63P can be provided around the rotation axis A-A, each with at least one coolant delivery duct 65 in connection therewith, to obtain a more uniform delivery of coolant agent into the coolant-inlet plenum 63P and in the third coolant passage 48.

On the side of the second inner core 55 opposite the coolant-inlet plenum 63P, a coolant outlet 67 can be provided, comprised of a coolant-outlet plenum 67P, which can be annular in shape. In other embodiments, two semi-annular inlet plenums 63P can be provided instead. The coolant-outlet plenum 67P can be in fluid communication with a coolant removing duct 69.

As shown in FIG. 3, a coolant agent flow path is thus formed starting at the coolant inlet 63 and ending to the coolant outlet 67. The coolant flow path starts at the inlet plenum 63P and extends behind the third wall 61 along the third coolant passage 48 radially inwardly till an intermediate plenum 50, wherefrom the coolant agent flows through ports 59 into a second intermediate plenum 52 and therefrom into and through the portion 48A of the third coolant passage.

From the portion 48A of the third coolant passage 48 the coolant agent flows through the plurality of inlet ducts 19A through the return-channel blades 19 into the first coolant passage 47 in the internal diaphragm portion 21. Here the coolant agent flows around the first inner core 43, behind the surfaces 21A, 21B and 21C of the internal diaphragm portion 21B. Thereafter the coolant agent flows through the outlet ducts 19B into the second coolant passage 49 and is finally collected in the outlet plenum 67P and exits through the coolant removing ducts 69.

The coolant agent flow path described so far is configured such that almost the entire stationary diaphragm surface contacted by the gas exiting the impeller outlet 9F until the apex of the second diffuser 17 is efficiently cooled. The narrow coolant passages formed inside the internal diaphragm portion 21 and the external diaphragm portion 23 generate a high speed coolant flow just behind the thin walls separating the cooling chamber 49 and the coolant passage 47 from the respective external surfaces of the diaphragm portions 21 and 23.

In some embodiments according to the subject matter disclosed herein, both the internal diaphragm portion 21 and the external diaphragm portion 23 are thus provided with respective skins behind which a cooling meatus is formed, between the skin and the inner cores 43, 55. In the cooling meatus the coolant agent flows at high speed thus efficiently removing heat from almost the entire surface of the return diffuser return channel 15 and diffusers 13, 17, which are contacted by the processed gas.

According to some embodiments, the external diaphragm portion 23 arranged around the upstream impeller 11 further comprises a respective third and second coolant passages 71C, 71B and 71A, respectively, which are substantially shaped as the third coolant passages 48 and 49.

A coolant inlet plenum 73P forming part of a coolant inlet 73 is in fluid communication with the third coolant passage 71C. The latter is in fluid communication through ports 73 with the section, annular intermediate plenums 75 and 77 being arranged at the inlet and at the outlet of ports 73.

The third coolant passage 71B and the second coolant passage 71A are fluidly coupled with a first coolant passage 79 provided in the internal diaphragm portion 31 arranged upstream of the upstream impeller 9, and having substantially the same shape and function as the coolant passage 47 provided in the internal diaphragm portion 21. The coolant passage 79 of the internal diaphragm portion 31 is fluidly connected through ducts formed in the return-channel blades 29 with the third coolant passage 71B and with the second coolant passage 71A, quite in the same way as provided by the inlet and outlet ducts 19A and 19B for the coolant passage 47.

In some embodiments, the second coolant passage 71A is further provided with a coolant outlet 81 comprised of a coolant outlet plenum 81P in fluid communication with outlet ducts 83.

Third coolant passage 71C extends behind a wall 85, the outer surface 85A whereof delimits the upstream diffuser 13 of the impeller 9. Thus the third coolant duct 71C provides for heat removal through wall 85 from the gas which flows through and along the upstream diffuser 13.

Figure 4:
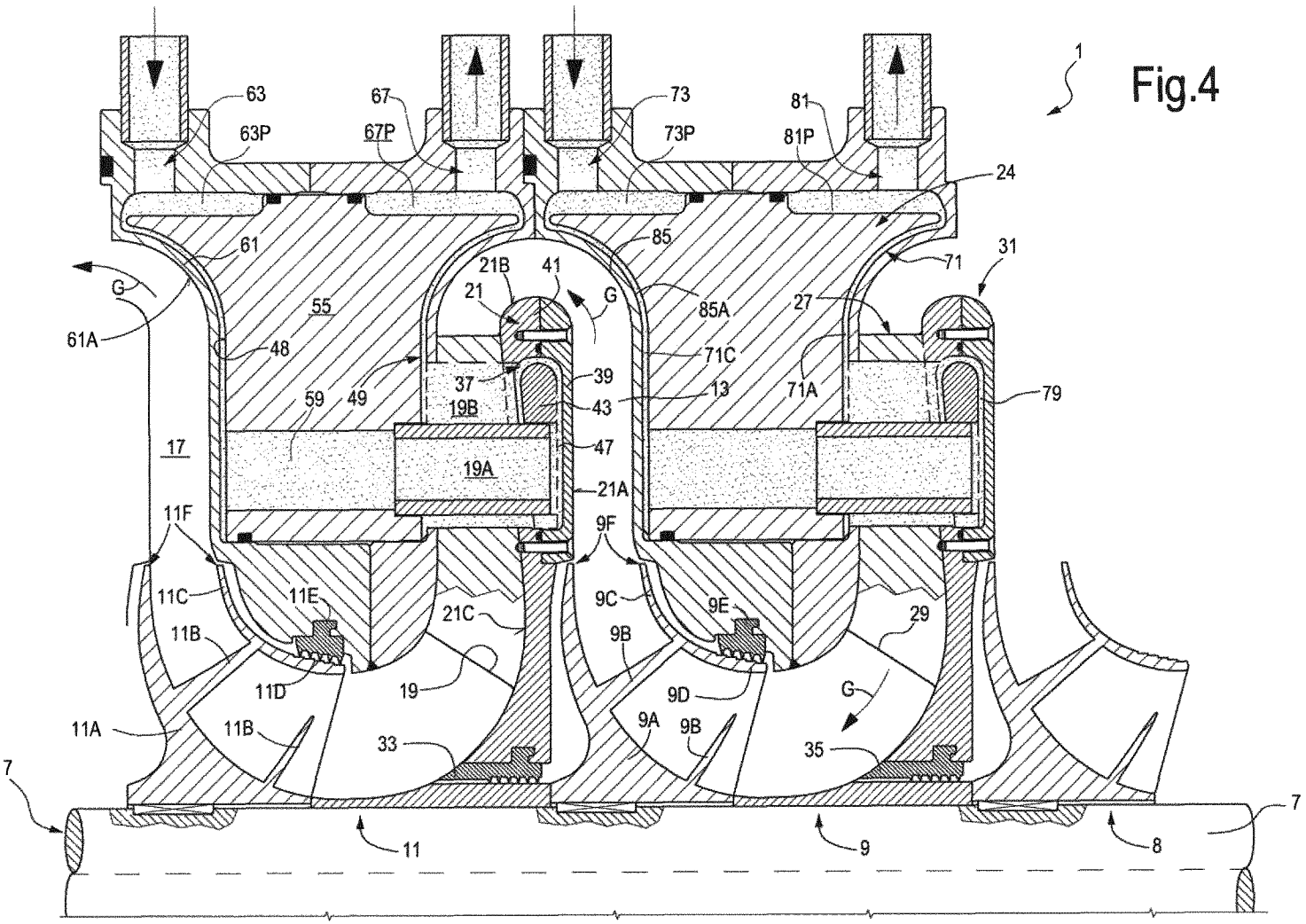
Figure 5:
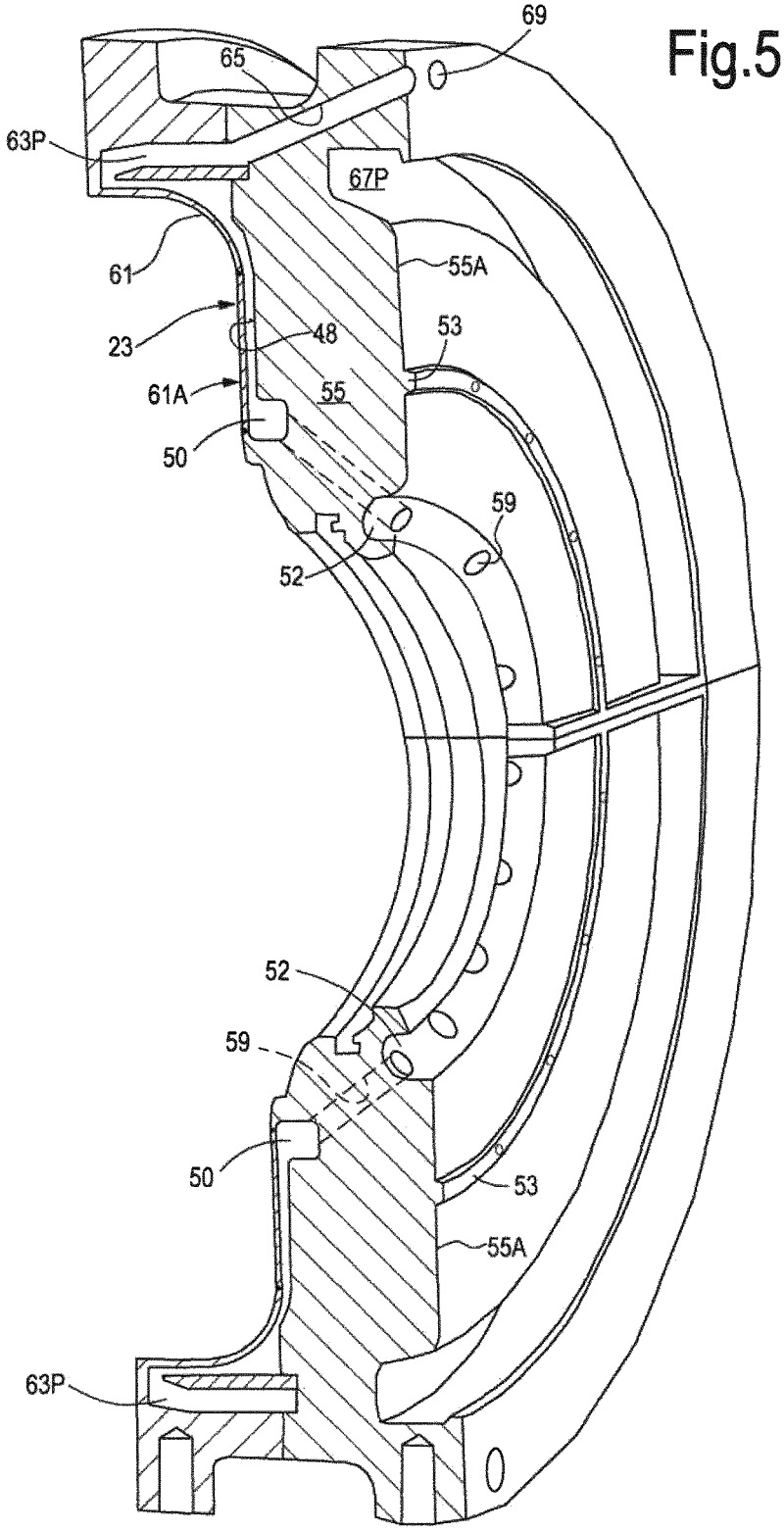
FIG. 5 illustrates a fragmentary perspective view of the external diaphragm portion with parts removed of the compressor of FIG. 3.
Figure 6:
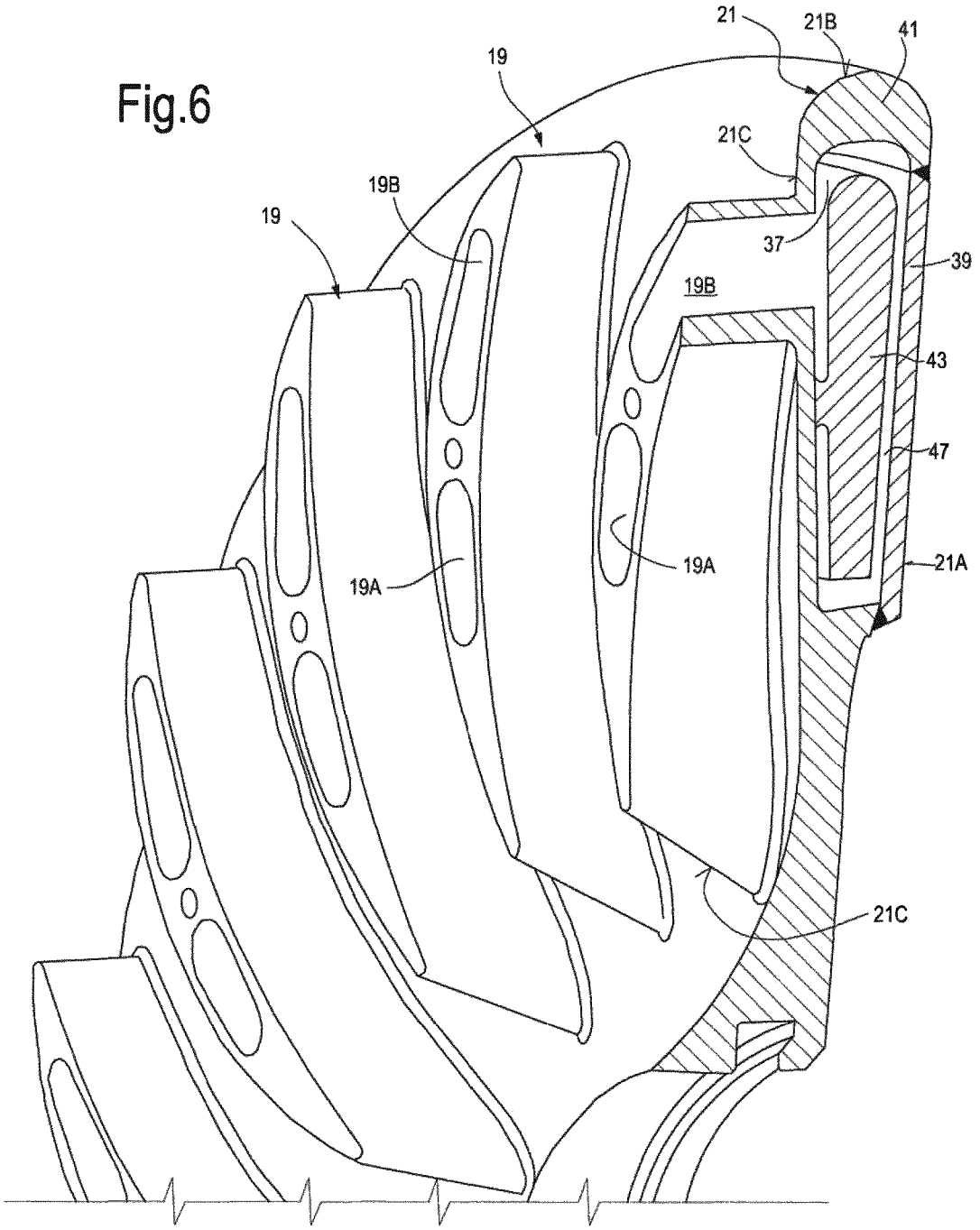
FIG. 6 illustrates a fragmentary perspective view of the return channel blades of the compressor of FIG. 3.

FIG. 4 illustrates a sectional view of a further embodiment of the subject matter disclosed herein. The same reference number as in FIG. 3 designates the same or similar parts of the components.

In the sectional view of FIG. 4 three impellers 8, 9 and 11 are shown, belonging to three subsequently arranged compressor stages in compressor 1.

Impellers 8, 9 and 11 can be substantially similar to one another, as shown in FIG. 3. Their dimension can be slightly different in consideration of the reduced volume rate of the gas processed by the two impellers 9, 11 which are arranged in sequence along the compressor 1.

Two sequentially arranged upstream and downstream impeller 9, 11 are combined with a respective stationary diaphragm 5. Each impeller 9, 11 is comprised of a respective impeller disc 9A, 11A and a plurality of impeller blades 9B, 11B. In some embodiments the impellers can be provided with respective shrouds 9C, 11C. In other embodiments, not shown, the impellers 9, 11 can be open, i.e. unshrouded. The shrouds 9C, 11C can each be provided with an impeller eye 9D which co-acts with a respective impeller sealing arrangement 9E 11E.

Downstream of the upstream impeller 9 an upstream diffuser 13 is arranged, fluidly coupled to the outlet of the upstream impeller 9. Gas accelerated by the impeller 9 is slowed down in the diffuser 13, such that at least part of the kinetic energy delivered to the gas by the impeller 9 is converted into pressure energy. A return channel 15 is fluidly coupled to the outlet of the upstream diffuser 13 and to the inlet of downstream impeller 11. The gas flow G is returned through a return channel 15 towards the inlet of the downstream impeller 11. A downstream diffuser 17, similar to upstream diffuser 13 and only partly shown in FIG. 3, can be arranged in fluid communication with the outlet of the downstream impeller 11, with an arrangement quite similar to upstream diffuser 13.

The return-channel 15 can be provided with a plurality of stationary blades or vanes 19. Here below the vanes or blades 19 will be designated as return-channel blades 19. The return-channel blades 19 can be uniformly distributed around the rotation axis A-A of the impellers 9, 11.

Between the diffuser 13 and the return-channel 15 an internal diaphragm portion 21 is arranged. The internal diaphragm portion 21 can have a substantially annular shape and may be connected mechanically by means of the return-channel blades 19 to an external diaphragm portion 23. The external diaphragm portion 23 and the internal diaphragm portion 21 form the return-channel 15. In some embodiments the internal diaphragm portion 21 can have outer surfaces 21A, 21B, 21C. The outer surface 21A faces the upstream diffuser 13 and is in fluid contact with the gas flowing through the upstream diffuser. The outer surface 21B is the most radially outward outer surface of the internal diaphragm portion 21 and is arranged at the apex of the upstream diffuser 13, where the latter connects with the return channel 15. Thus, the surface 21B is in fluid contact with the gas moving from the diffuser 13 towards the return channel 15. The third outer surface 21C extends along the return channel 15 and is in fluid contact with the gas flowing through the return channel 15 and between the return-channel blades 19.

The upstream diffuser 13 is formed by the internal diaphragm portion 21 and by the external diaphragm portion 23 of a diaphragm arranged upstream of impeller 9. Similarly, the downstream diffuser 17 is formed by the external diaphragm portion 23 of the diaphragm 5 arranged between upstream and downstream impellers 9, 11 and by the internal diaphragm portion (not shown) of the next impeller or by the compressor volute or scroll (not shown).

The internal diaphragm portion 21 and the external diaphragm portion 23 form therein a cooling arrangement, where through a coolant agent flows, as will be described in greater detail here below.

Reference number 27 indicates the respective return-channel of a further upstream compressor stage having return-channel blades 29 therein. The return-channel 27 of the upstream compressor stage is formed between the external diaphragm portion 23 and a respective further internal diaphragm portion 31, which is mechanically connected to the external diaphragm portion 23 through the return-channel blades 29. As will become apparent from the following description, in the exemplary embodiment of FIG. 3 integrated intercooling is provided also between impeller 9 and the impeller upstream thereof. In other embodiments, intercooling upstream of the impeller 9 can be dispensed with. In some exemplary embodiments, the impeller 9 can be the first compressor impeller, in which case an inlet plenum will be provided upstream thereof, rather than return channel 27.

In embodiments disclosed herein, the internal diaphragm portion 21 has an inner cavity 37 which can be closed by means of a cover or plate 39. The cover or plate 39 can be welded to a main body 41 of the internal diaphragm portion 21. In other embodiments, connection between the main body 41 and the cover can be by screwing or in any outer suitable manner. As can be appreciated from FIG. 3, the cover 39 can have an annular shape and extend around the rotation axis A-A of compressor 1.

The inner cavity 37 has an annular development around the rotation axis A-A. In some embodiments, a first inner core 43 is arranged inside the inner cavity 37. The inner core 43 can have an annular shape. In some embodiments the inner core 43 is connected through a plurality of screws or other suitable means 45 to the external diaphragm portion 23. In some embodiments the screws 45 extend through respective return-channel blades 19. The return-channel blades 19 in combination with screws 45 thus connect the internal diaphragm portion 21 to the external diaphragm portion 23.

In some embodiments the inner core 43 and the inner surface of the inner cavity 37 form a first coolant passage 47. As can be appreciated from FIG. 3, in some embodiments the first coolant passage 47 has a substantially loop-shaped section in a radial plane, i.e. in a plane containing the rotation axis A-A.

The first coolant passage 47 can extend around and behind the outer surfaces 21A, 21B, 21C of the internal diaphragm portion 21. The coolant passage 47 can be provided with a first section in heat-exchange relationship with the return-channel 15 and a second section in heat-exchange relationship with the diffuser 13.

More specifically, the coolant passage 47 has a portion thereof arranged behind the outer surface 21C of the internal diaphragm portion 21 in heat-exchange relationship with the return-channel 15 and a portion behind surface 21A in heat-exchange relationship with the return-channel 13.

In some embodiments, the external diaphragm portion 23 comprises a second inner core 55 and coolant passages extending at least partly around the second inner core 55 as described in more detail here below.

According to some embodiments, a second coolant passage 49 is provided, which extends behind a substantially annular second wall 51 of the external diaphragm portion 23. More specifically, the second coolant passage 49 can extend between the annular second wall 51 and the second inner core 55. The outer surface MA of the annular second wall 51 can form the downstream inner surface of the return-channel 15, facing surface 21C formed by the internal diaphragm portion 21.

A third coolant passage 48 can be provided around the second inner core 55. The third coolant passage 48 extends around the second inner core 55 on the side opposite the second coolant passage 49, i.e. along the side of the second inner core 55 facing the downstream return channel 17. The third coolant passage 48 is fluidly coupled with inlet ducts 19A extending through at least some of the blades 19. Ports 59 connect the third coolant passage 48 with the inlet ducts 19A of the return-channel blades 19. Outlet ducts 19B extending through the return-channel blades 19 are in fluid communication with the second coolant passage 49. The arrangement is such that coolant agent flows through the third coolant duct 48, ports 59, inlet ducts 19A, first coolant passage 47, outlet ducts 19B and second coolant passage 49.

In some embodiments, the third coolant passage 48 extends behind a third wall 61, the outer surface 61A whereof forms one of the inner surfaces of the downstream diffuser 17 arranged at the outlet 11F of the second impeller 11. Coolant agent flowing there along thus removes heat through third wall 61 from gas flowing through the downstream diffuser 17. Coolant agent flowing through the second coolant passage 49 removes heat from the first portion (i.e. the most upstream portion, according to the direction of flow of the gas) of the return channel 15.

In some embodiments, the third coolant passage 48 is in fluid communication with a coolant inlet 63 which can comprise a coolant-inlet plenum 63P. According to some embodiments, the coolant-inlet plenum 63P has an annular shape and extends around the rotation axis A-A. One or more coolant delivery ducts 65 can be in fluid communication with the coolant inlet 63 for delivering a coolant agent therein. In some embodiments, the coolant-inlet plenum 63P can be semi-annular and two said coolant-inlet plenums 63P can be provided around the rotation axis A-A, each with at least one coolant delivery duct 65 in connection therewith, to obtain a more uniform delivery of coolant agent into the coolant-inlet plenum 63P and in the third coolant passage 48.

On the side of the second inner core 55 opposite the coolant-inlet plenum 63P, a coolant outlet 67 can be provided, comprised of a coolant-outlet plenum 67P, which can be annular in shape. In other embodiments, two semi-annular inlet plenums 63P can be provided instead. The coolant-outlet plenum 67P can be in fluid communication with a coolant removing duct 69.

The coolant agent flow path described so far is configured such that almost the entire stationary diaphragm surface contacted by the gas exiting the impeller outlet 9F until the apex of the second diffuser 17 is efficiently cooled. The narrow coolant passages formed inside the internal diaphragm portion 21 and the external diaphragm portion 23 generate a high speed coolant flow just behind the thin walls separating the cooling chamber 49 and the coolant passage 47 from the respective external surfaces of the diaphragm portions 21 and 23.

According to some embodiments, the external diaphragm portion 23 arranged around the upstream impeller 11 further comprises a respective third and second coolant passages 71C and 71A, respectively, which are substantially shaped as the third coolant passages 48 and 49. A coolant inlet plenum 73P forming part of a coolant inlet 73 is in fluid communication with the third coolant passage 71C. The latter is in fluid communication through ports 73 with the section, annular intermediate plenums 75 and 77 being arranged at the inlet and at the outlet of ports 73.

The third coolant passage 71C and the second coolant passage 71A are fluidly coupled with a first coolant passage 79 provided in the internal diaphragm portion 31 arranged upstream of the upstream impeller 9, and having substantially the same shape and function as the coolant passage 47 provided in the internal diaphragm portion 21. The coolant passage 79 of the internal diaphragm portion 31 is fluidly connected through ducts formed in the return-channel blades 29 with the third coolant passage 71C and with the second coolant passage 71A, quite in the same way as provided by the inlet and outlet ducts 19A and 19B for the coolant passage 47.

In some embodiments, the second coolant passage 71A is further provided with a coolant outlet 81 comprised of a coolant outlet plenum 81P in fluid communication with outlet ducts 83.

Third coolant passage 71C extends behind a wall 85, the outer surface 85A whereof delimits the upstream diffuser 13 of the impeller 9. Thus the third coolant duct 71C provides for heat removal through wall 85 from the gas which flows through and along the upstream diffuser 13.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. An internally cooled centrifugal compressor, the centrifugal compressor comprising:

a casing;

at least an upstream impeller and a downstream impeller sequentially arranged for rotation in the casing;

a stationary diaphragm arranged in the casing and comprised of an internal diaphragm portion and an external diaphragm portion;

an upstream diffuser fluidly coupled to an outlet of the upstream impeller;

a return channel fluidly coupled to the upstream diffuser and to an inlet of the downstream impeller, the return channel provided with a plurality of return-channel blades connecting the internal diaphragm portion to the external diaphragm portion; and a downstream diffuser fluidly coupled to an outlet of the downstream impeller;

wherein a first coolant passage is provided in the internal diaphragm portion and extends around a first inner core arranged in the internal diaphragm portion, the first coolant passage being in heat-exchange relationship with the upstream diffuser and the return channel; and wherein a second coolant passage and a third coolant passage are provided in the external diaphragm portion, separated by a second inner core arranged in the external diaphragm portion, the second coolant passage and third coolant passage being in heat-exchange relationship with the return channel and the downstream diffuser.

2. The centrifugal compressor of claim 1, wherein inlet coolant ducts and outlet coolant ducts extend through the return-channel blades, for circulating coolant through the first coolant passage.

3. The centrifugal compressor of claim 1, wherein a plurality of inlet ducts extending through the return-channel blades fluidly connect the third coolant passage in the external diaphragm portion to the first coolant passage in the internal diaphragm portion; and wherein a plurality of outlet ducts extending through the return-channel blades fluidly connect the first coolant passage to the second coolant passage.

4. The centrifugal compressor of claim 1, wherein the third coolant passage is in heat-exchange relationship with the downstream diffuser and the second coolant passage is in heat-exchange relationship with the return channel.

5. The centrifugal compressor of claim 1, wherein: a coolant inlet and a coolant outlet are arranged in the external diaphragm portion in fluid communication with the third and second coolant passages.

6. The centrifugal compressor of claim 5, wherein the coolant inlet, the coolant outlet and the first, second and third coolant passages are arranged such that coolant enters from the coolant inlet and exits through the coolant outlet and flows sequentially: through the third coolant passage arranged in the external diaphragm portion and in heat-exchange relationship with the downstream diffuser; through the first coolant passage, in heat-exchange relationship with the upstream diffuser and the return channel; and through the second coolant passage, in heat-exchange relationship with the return channel.

7. The centrifugal compressor of claim 5, wherein the coolant inlet comprises an annular coolant-inlet plenum.

8. The centrifugal compressor of claim 5, wherein the coolant outlet comprises an annular coolant-outlet plenum.

9. The centrifugal compressor of claim 1, wherein the first coolant passage has a substantially loop shape in radial section and extends between the first inner core and a cover forming a surface of the upstream diaphragm, and between the first inner core and a first wall forming a surface of the return channel, whereto the return-channel blades are connected.

10. The centrifugal compressor of claim 1, wherein the third coolant passage and the second coolant passage form a cooling loop at least partly surrounding the second inner core.

11. The centrifugal compressor of claim 1, wherein the second coolant passage extends between the second inner core and a second wall forming a surface of the return channel whereto the return channel blades are connected.

12. The centrifugal compressor of claim 1, wherein the third coolant passage extends between the second inner core and a third wall forming a surface of the downstream diffuser.

13. The centrifugal compressor of claim 1, wherein a plurality of ports extend through the second inner core, where through coolant flows from the third coolant passage towards the first coolant passage.

* * * * *